US010407085B2

(12) United States Patent
Kawabata et al.

(10) Patent No.: US 10,407,085 B2
(45) Date of Patent: Sep. 10, 2019

(54) TRAIN TRAVEL PREDICTION DEVICE AND TRAIN TRAVEL PREDICTION METHOD

(71) Applicant: Mitsubishi Electric Corporation, Chiyoda-ku, Tokyo (JP)

(72) Inventors: Yasuyuki Kawabata, Tokyo (JP); Yusaku Nagasaki, Tokyo (JP); Koki Yoshimoto, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 264 days.

(21) Appl. No.: 15/305,278

(22) PCT Filed: Apr. 21, 2014

(86) PCT No.: PCT/JP2014/061181
§ 371 (c)(1),
(2) Date: Oct. 19, 2016

(87) PCT Pub. No.: WO2015/162670
PCT Pub. Date: Oct. 29, 2015

(65) Prior Publication Data

US 2017/0043798 A1 Feb. 16, 2017

(51) Int. Cl.

| | |
|---|---|
| ***B61L 27/00*** | (2006.01) |
| ***B61L 25/02*** | (2006.01) |
| ***G08G 1/127*** | (2006.01) |

(52) U.S. Cl.
CPC ..... *B61L 27/0016* (2013.01); *B61L 25/025* (2013.01); *B61L 27/0022* (2013.01); *G08G 1/127* (2013.01)

(58) Field of Classification Search
CPC ..... B61L 27/0016; B61L 27/0022; B61L 25/025; G08G 1/127
(Continued)

(56) References Cited

U.S. PATENT DOCUMENTS 5,659,734 A 8/1997 Tsuruta et al.
2014/0180510 A1* 6/2014 Fournier et al. .... B61L 27/0027 701/20
(Continued)

FOREIGN PATENT DOCUMENTS

GB 2492012 A * 12/2012 ..... B61L 27/0027
GB 2492012 A 12/2012
(Continued)

OTHER PUBLICATIONS

International Search Report (PCT/ISA/210) dated Jul. 22, 2014, by the Japanese Patent Office as the International Searching Authority for International Application No. PCT/JP2014/061181.
(Continued)

*Primary Examiner* — Anne M Antonucci
*Assistant Examiner* — James E Stroud
(74) *Attorney, Agent, or Firm* — Buchanan Ingersoll & Rooney PC

(57) ABSTRACT

A train travel prediction device includes a required time database that records a station-to-station required timetable created in advance between stations and indicating a relation of a time difference between a last station departure time of a target train and a next station departure time of a precedent train with respect to a required time of the target train to a next station by the use of a train simulation on the basis of a train moving condition and an operation prediction unit that creates a prediction schedule on the basis of information of the required time acquired for each target train during a prediction period by referring to the station-to-station required timetable recorded in the required time database on the basis of information of a train schedule and a train arrival-departure time.

8 Claims, 4 Drawing Sheets

(58) Field of Classification Search
USPC ..... 701/117
See application file for complete search history.

(56) References Cited

U.S. PATENT DOCUMENTS

| | | | | |
|---|---|---|---|---|
| 2015/0177011 | A1* | 6/2015 | Ibrahimi | G01C 21/343 701/465 |
| 2015/0228193 | A1* | 8/2015 | Bick | G01C 21/3423 340/990 |

FOREIGN PATENT DOCUMENTS

| | | | | |
|---|---|---|---|---|
| GB | 2537434 | A | * 10/2016 | B61L 27/0016 |
| JP | 09-104347 | A | 4/1997 | |
| JP | 2715647 | B2 | 2/1998 | |
| JP | 2004-266986 | A | 9/2004 | |
| JP | 2006-143088 | A | 6/2006 | |
| JP | 2008-162400 | A | 7/2008 | |
| JP | 2011-006009 | A | 1/2011 | |
| JP | 2011-218838 | A | 11/2011 | |

OTHER PUBLICATIONS

Office Action dated Jul. 9, 2019, by the India Patent Office in corresponding India Patent Application No. 201647035361 and English translation of the Office Action. (6 pages).

* cited by examiner

| DEPARTURE TIME DIFFERENCE | REQUIRED TIME |
|---|---|
| -10 | 150 |
| 0 | 155 |
| 10 | 165 |
| 20 | 180 |
| 30 | 195 |

TRAIN TRAVEL PREDICTION DEVICE AND TRAIN TRAVEL PREDICTION METHOD

FIELD

The present invention relates to a train travel prediction device and a train travel prediction method.

BACKGROUND

In the past, as a technique of predicting an operation status of a train in future, there has been a technique of performing a precise prediction by calculating a train moving state on the basis of a signal condition or a technique of performing a prediction by simply adding a station-to-station required time and an arrival-departure time interval. In the former technique, prediction precision is high, but a calculation time is long. In the latter technique (the unit of station prediction), prediction precision is low, but a calculation time is short.

In the unit of station prediction, a station-to-station travel time and a station stop time are sequentially added to a departure time and an arrival time from a prior side in terms of time so as to calculate an arrival time and a departure time of the next station. For example, when a departure time of a precedent train is delayed, a time obtained by adding a last station departure time of a subsequent train to a minimum travel time between the stations is compared with a time obtained by adding a next station departure time of the precedent train to a minimum arrival-departure time interval and a calculation is performed while the later time is set as a next station arrival time of the subsequent train.

CITATION LIST

Patent Literature

Patent Literature 1: Japanese Patent No. 2715647

SUMMARY

Technical Problem

However, according to the above-described related art, the train moving state is not accurately considered. For that reason, since the minimum arrival-departure time interval is determined as a predetermined value, a problem arises in that an error may occur in accordance with an operation of an actual train.

The present invention is made in view of the above-described circumstances and an object of the present invention is to obtain a train travel prediction device and a train travel prediction method capable of improving operation prediction precision by a prediction performed by the unit of station without causing an increase in calculation time.

Solution to Problem

To solve the above described problem and achieve the object, a train travel prediction device according to the present invention includes: a required time storage unit that records a required timetable created in advance between stations and indicating a relation of a time difference between a last station departure time of a target train and a next station departure time of a precedent train with respect to a required time of the target train to a next station by the use of a train simulation on the basis of a train moving condition; and an operation prediction unit that creates a prediction schedule on the basis of information of a required time acquired for each target train during a prediction period by referring to the required timetable recorded in the required time storage unit on the basis of information of a train schedule and a train arrival-departure time.

Advantageous Effects of Invention

According to the present invention, there is an effect in which the operation prediction precision can be improved by the prediction performed by the unit of station prediction without causing an increase in calculation time.

DESCRIPTION OF EMBODIMENTS

Hereinafter, an embodiment of a train travel prediction device and a train travel prediction method according to the present invention will be described in detail with reference to the drawings. Further, the present invention is not limited to the embodiment.

Embodiment

Figure 1:
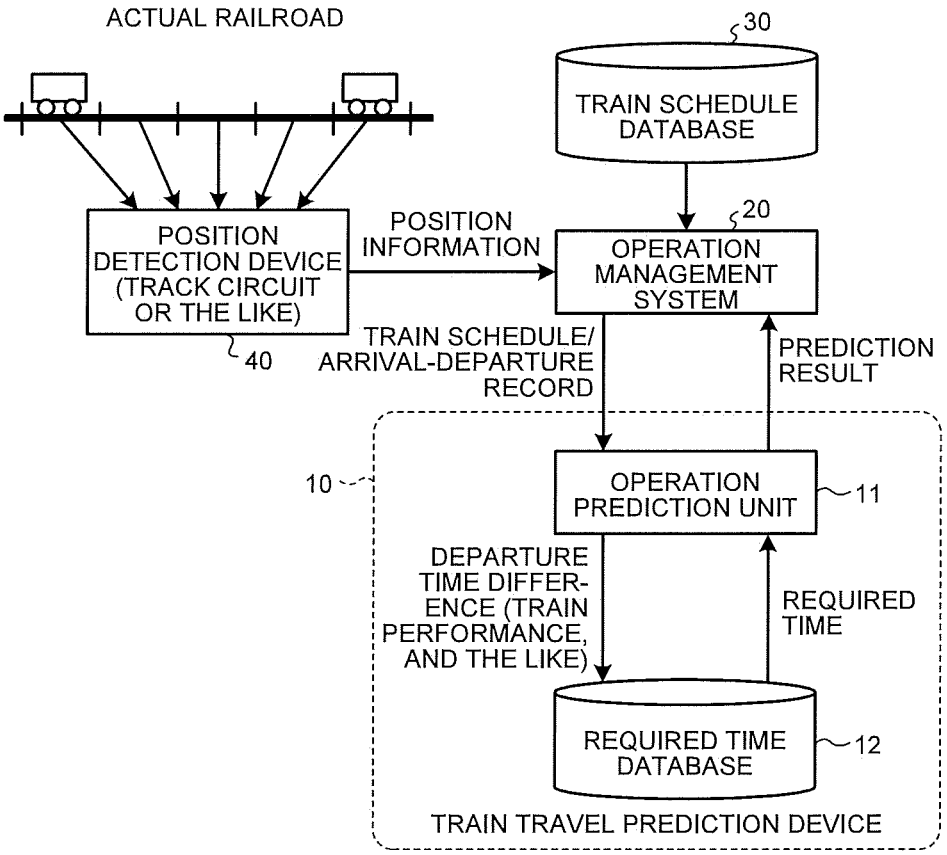
FIG. 1 is a diagram illustrating a configuration example of a train operation system using a train travel prediction device.

FIG. 1 is a diagram illustrating a configuration example of a train operation system using a train travel prediction device of the present embodiment. The train operation system includes a train travel prediction device 10, an operation management system 20, a train schedule database (DB) 30, and a position detection device 40. The train travel prediction device 10 includes an operation prediction unit 11 and a required time database (DB) 12.

In the train travel prediction device 10, the operation prediction unit 11: refers to the required time DB 12 on the basis of a train schedule acquired from the operation management system 20 and an arrival-departure record of a train to each station until a current time point; acquires a required time corresponding to a departure time difference of a station of a target train from the required timetable stored in the required time DB 12; predicts the operation of the train after the current time point; creates a prediction result (a prediction schedule); and outputs the prediction result to the operation management system 20.

The operation management system 20 traces the position information detected by the position detection device 40 and creates the arrival-departure record of the train to and from the station. The operation management system 20 receives a predetermined train schedule from the train schedule DB 30 and corrects or changes an arrival-departure order if necessary.

The train schedule DB 30 is a database which stores a train schedule of a target track in the operation management system 20.

The position detection device 40 detects a train position by a track circuit or the like from an actual train system and notifies the operation management system 20 of the train position information.

Subsequently, a train travel prediction method which is performed by the unit of station prediction using the train travel prediction device 10 will be described. In order to clarify a difference between the present invention and the related art, the prediction performed by the unit of station prediction of the related art will be described first and the principle of the prediction performed by the unit of station prediction of the present embodiment will be described next.

Figure 2:
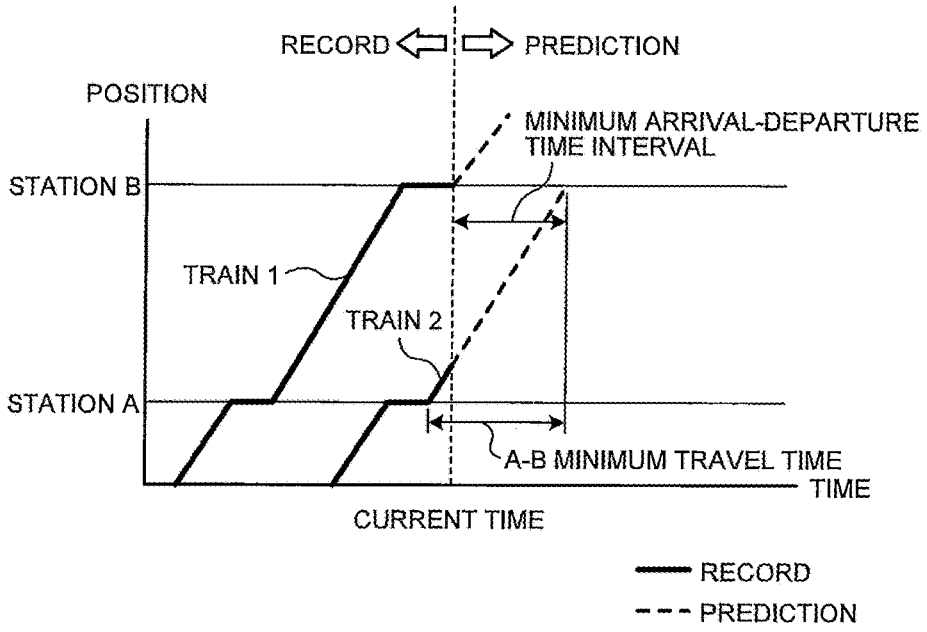
FIG. 2 is a diagram illustrating a unit of station prediction of the related art.

FIG. 2 is a diagram illustrating the prediction performed by the unit of station prediction of the related art. Here, FIG. 2 a diagram that depicts a state the trains travel in a direction from a station A to a station B on the assumption that a train 1 indicates a precedent train and a train 2 indicates a subsequent train. As described in the background art, when the departure time of the train 1 as the precedent train at the station B is delayed, a time obtained by adding a minimum travel time between the station A and the station B to the departure time of the train 2 as the subsequent train at the station A is compared with a time obtained by adding a minimum arrival-departure time interval to the departure time of the precedent train and a calculation is performed while the later time is set as the arrival time of the train 2 as the subsequent train at the station B. However, in this method, since the minimum arrival-departure time interval is uniform, an error occurs in accordance with the operation of the actual train.

Figure 3:
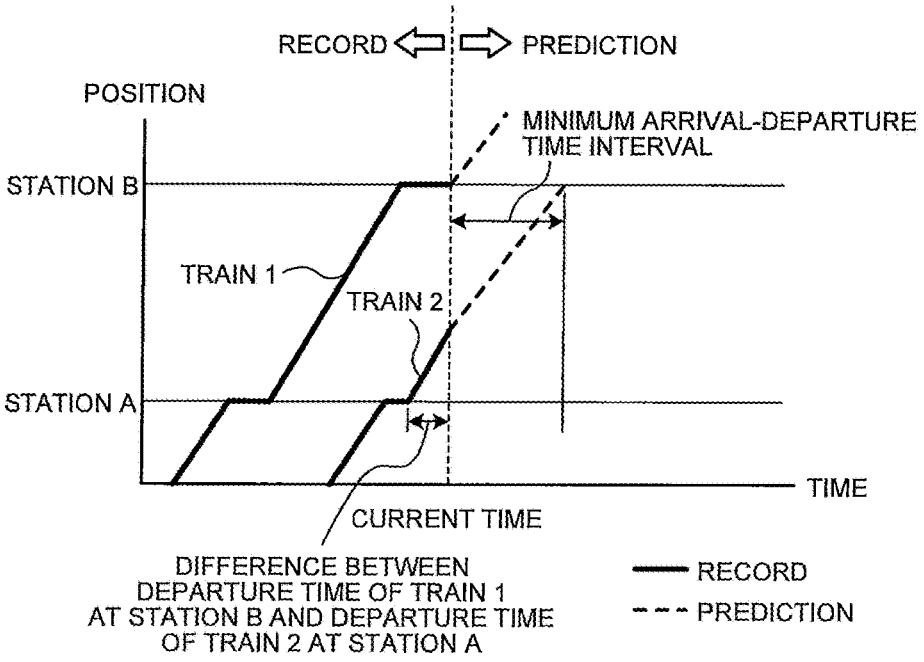
FIG. 3 is a diagram illustrating a principle of a unit of station prediction of the present embodiment.

FIG. 3 is a diagram illustrating a principle of a prediction performed by the unit of station prediction of the present embodiment. The minimum arrival-departure time interval at the station B is determined depending on the travel modes of the train 1 and the train 2. If the method is uniform when the train 1 departs from the station B, the minimum arrival-departure time interval at the station B is determined only by the travel mode of the train 2 between the station A and the station B. In actual, the travel mode of the train 2 between the stations is substantially uniform and only a signal condition on the basis of an interval between the train 2 and the train 1 as the precedent train changes. Since the interval between the train 1 and the train 2 is determined by a difference between the departure time of the train 1 at the station B and the departure time of the train 2 at the station A, the actual minimum arrival-departure time interval at the station B can be obtained from the departure time difference.

In the present embodiment, the operation of the train is calculated in advance with high precision in consideration of a train moving condition, a signal condition, and the like and a table (a required timetable) representing a relation between the departure time difference and the minimum arrival-departure time interval is created. Accordingly, it is possible to obtain a more accurate train operation prediction result by obtaining an appropriate minimum arrival-departure time interval from the departure time difference of the station when the prediction is performed by the unit of station prediction later. Further, when the prediction is performed by the unit of station prediction, only the previously created table (the required timetable) may be referred to without causing an increase in calculation time.

Figures 4, 5:
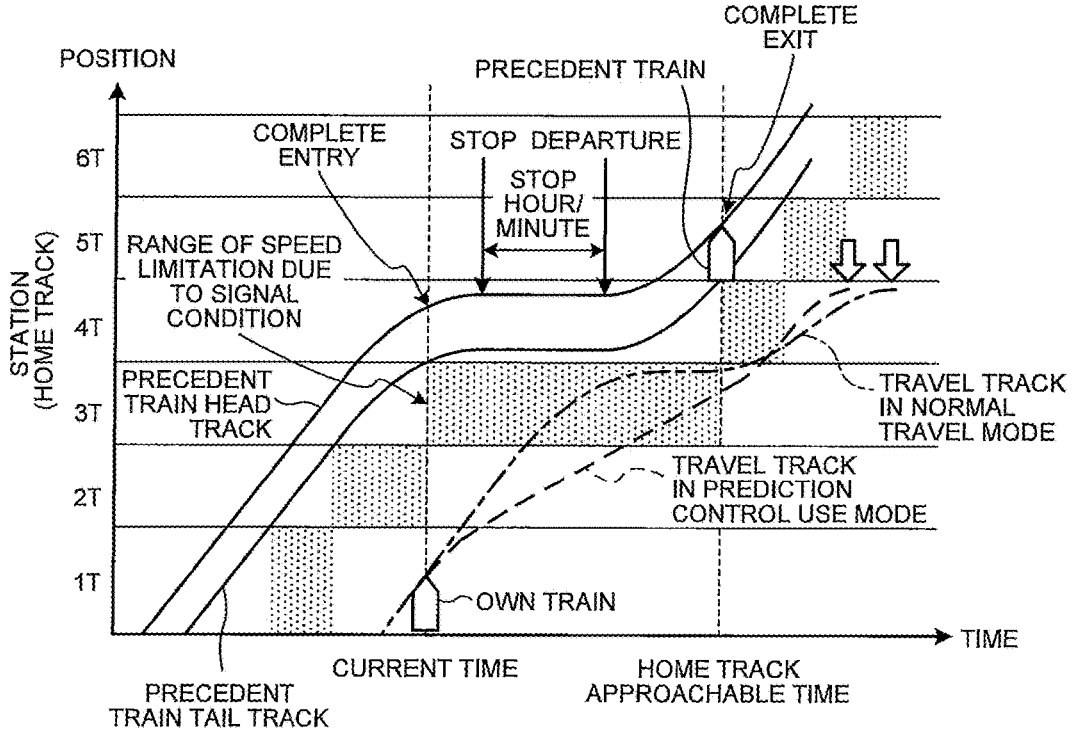
FIG. 4 is a diagram illustrating a configuration example of a required timetable.
FIG. 5 is a diagram illustrating an image of a method of calculating a required time recorded in the required timetable.

FIG. 4 is a diagram illustrating a configuration example of a required timetable stored in the required time DB 12. Here, a relation between the departure time difference and the required time is illustrated. A structure is obtained in which the required time of the train to the next station can be referred from a difference between the departure time of the precedent train (the train 1 of FIGS. 2 and 3) at the next station (the station B of FIGS. 2 and 3) and the departure time of the train (the subsequent train: the train 2 of FIGS. 2 and 3) at the last station (the station A of FIGS. 2 and 3). Here, as an example, the required timetable between the station A and the station B is illustrated, but is prepared in at least every zone in a target track in which the train travels according to the similar table in the required time DB 12.

As illustrated in FIG. 4, when the departure time of the precedent train at the next station (the station B) is early, the departure time difference has a minus value. Meanwhile, as the departure time of the precedent train at the next station (the station B) is delayed, that is, the departure time has a plus value, the required time of the train (the subsequent train) gradually increases and the arrival time of the train (the subsequent train) at the next station (the station B) is delayed. This is because the train is limited by the signal condition as the departure time of the precedent train to the next station is delayed. Thus, the speed needs to be decreased.

In the required time DB 12, the same station-to-station required timetable is prepared in at least every station-to-station zone. However, a plurality of the station-to-station required timetables may be prepared in the same station-to-station zone in response to, for example, a speed limit between the stations, a travel pattern, a train performance, and the like. In the operation prediction unit 11, an appropriate station-to-station required timetable may be selected and referred to, from the station-to-station required timetables between the stations in response to a set speed limit between the stations, a travel pattern, a train performance, and the like.

When there is a train which departs from the station A, passes through the station B, and arrives at the station C, the required timetable between the station A to the station C may be prepared. Otherwise, the required timetable between the train departs from the station A and passes through the station B may be prepared; or the required timetable between the train passes passing through the station B and arrives at the station C may prepared. In this case, the operation prediction unit 11 uses a combination of the required timetable between the train departs from the station A and passes through the station B, and the required timetable between the train passes passing through the station B and arrives at the station C.

FIG. 5 is a diagram illustrating an image of a method of calculating a required time recorded in the required timetable. Generally, the speed of the subsequent train is limited by the travel mode of the precedent train and hence an approach prohibition range is set (in FIG. 5, only one position is illustrated for the easy comprehension, but the approach prohibition range corresponds to parts having a color different from a background). When the travel mode of the precedent train is set to be uniform, the travel track can be obtained by accurately calculating the movement of the target train (the subsequent train or the own train in FIG. 5) for the required time and the required time can be obtained therefrom. There is a case where the train existing between the stations travels by a particular travel mode. For example, there is a case where the speed of the train is limited or the train travels optimally by a prediction control in which the train travels at a limited speed on the basis of a predicted signal open time. Even in this case, the travel track can be calculated as illustrated in FIG. 5. Due to the previous calculation result, the required timetable can be created in advance.

In the present embodiment, the required timetable for every station-to-station is created in advance and is stored in the required time DB 12. As the operation prediction unit 11 acquires the information of the required time from the required time DB 12 on the basis of the arrival-departure record and the train schedule acquired from the operation management system 20, the information of the required time of the target train (the subsequent train) to the next station can be obtained with high precision.

Although not illustrated in FIG. 1, a configuration (a required time calculation unit) which creates the required timetable may be provided inside the train travel prediction device 10. However, the required timetable may be created by a device other than the train travel prediction device 10 and the data of the created required timetable may be stored in the required time DB 12.

Figure 6:
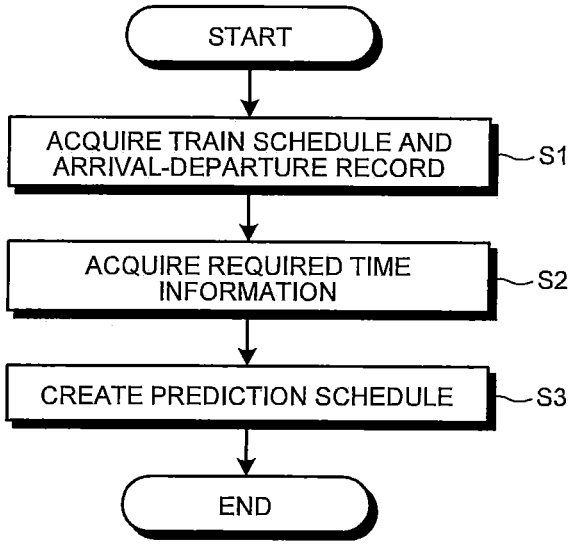
FIG. 6 is a flowchart illustrating a train travel prediction method performed by the unit of station prediction.

FIG. 6 is a flowchart illustrating a train travel prediction method performed by the unit of station prediction using the train travel prediction device 10. First, in the train travel prediction device 10, the operation prediction unit 11 acquires the information of the train schedule and the arrival-departure record from the operation management system 20 (step S1). The operation prediction unit 11 refers to the required time DB 12 on the basis of the train schedule and the arrival-departure record and obtains the information of the required time corresponding to the departure time difference of the required timetable between the target stations (step S2). Upon obtaining the information of the required time for the target train and the prediction period, the operation prediction unit 11 creates a prediction result (a prediction schedule) and outputs the prediction result to the operation management system 20 (step S3). When the operation prediction unit 11 creates the prediction schedule, the prediction schedule is created so that each train does not depart from the station at a time earlier than the original schedule.

The operation prediction unit 11 starts the prediction by using the arrival-departure time of the station of the target train at the current time of the prediction start time point. However, when the prediction period is long, the prediction is continued by using the information of the required time of each train predicted by the own device.

Figure 7:
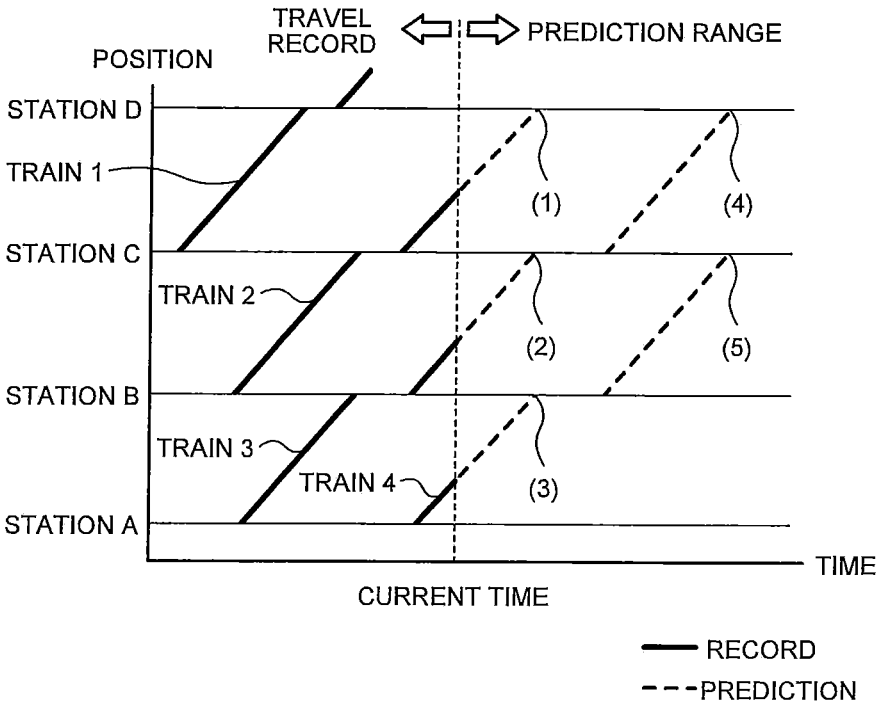
FIG. 7 is a diagram illustrating a prediction schedule creating method.

FIG. 7 is a diagram illustrating a prediction schedule creating method. The prediction range after the current time in FIG. 7 indicates the prediction result that is output from the operation prediction unit 11 to the operation management system 20. In FIG. 7, until the current time indicates the arrival-departure time record of the train at each station. The operation prediction unit 11 predicts the arrival time of the precedent train to the next station from the prior side in terms of time by referring to the required time on the basis of the recorded or predicted departure time of the precedent train and the recorded or predicted departure time of the own train. The operation prediction unit 11 predicts the train schedule after the current time by repeating and accumulating the prediction calculation. The operation prediction unit 11 uses a predetermined value for each station or a stop time on schedule as the stop time of the station in the prediction (the creation) of the train schedule. The operation prediction unit 11 performs the prediction until the last train of each day or within a range from a current time to a predetermined time so as to obtain a required prediction schedule.

In the operation prediction unit 11, as illustrated in FIG. 7, (1) indicates a prediction from a difference between the recorded departure time of the train 1 at the station D and the recorded departure time of the train 2 at the station C, (2) indicates a prediction from a difference between the recorded departure time of the train 2 at the station C and the recorded departure time of the train 3 at the station B, (3) indicates a prediction from a difference between the recorded departure time of the train 3 at the station B and the recorded departure time of the train 4 at the station A, (4) indicates a prediction from a difference between the recorded departure time of the train 2 at the station D and the recorded departure time of the train 3 at the station C, and (5) indicates a prediction from a difference between the recorded departure time of the train 3 at the station C and the recorded departure time of the train 4 at the station B.

The operation management system 20 can show an operator, who handles the operation management system 20, the influence of the disordered schedule and the way how the disordered schedule is restored when the train schedule is in disorder by obtaining the prediction result (the prediction schedule) from the operation prediction unit 11. The operator can take countermeasures against the disordered schedule by obtaining the prediction schedule predicted with high precision in a short time.

Further, when the information of the train schedule is output from the operation management system 20 to the operation prediction unit 11, for example, information representing a change in train operation order may be output on purpose. Accordingly, the operation prediction unit 11 can create and output the prediction schedule in response to the request from the operation management system 20.

As described above, according to the present embodiment, the train travel prediction device 10 includes the required time DB 12 which records the required timetable created in advance between the stations and indicating a relation of the time difference between the last station departure time of the target train and the next station departure time of the precedent train with respect to the required time of the target train to the next station by the use of a train simulation on the basis of the train moving condition. Then, the operation prediction unit 11: refers to the required timetable recorded in the required time DB 12 on the basis of the information of the train arrival-departure time and the train schedule acquired from the operation management system; acquires the station-to-station required time corresponding to the departure time difference of the station of the target train from the station-to-station required timetable; and creates the prediction schedule on the basis of the information of the required time acquired for each target train during the prediction period. Accordingly, the prediction can be performed by the unit of station prediction for the train at a high speed with high precision.

INDUSTRIAL APPLICABILITY

As described above, the train travel prediction device and the train travel prediction method according to the present invention are useful to manage the operation of the train and are suitably used particularly when the train schedule is in disorder.

REFERENCE SIGNS LIST

10 train travel prediction device, 11 operation prediction unit, 12 required time database (DB), 20 operation management system, 30 train schedule database (DB), 40 position detection device.

The invention claimed is:

1. A train travel prediction device comprising:

a required time database that records a required timetable created in advance between stations and indicating a relation of a departure time difference between a last station departure time of a target train and a next station departure time of a precedent train with respect to a required time for the target train from a current time to a next station on the assumption that the target train is set as a train subsequent to the precedent train and a stop station subsequent to a last station from which the target train has departed is set as the next station; and an operation prediction unit that refers to the required timetable recorded in the required time database on the basis of a train schedule and a train arrival-departure record including a last station departure time of the target train and a next station departure time of the precedent train, acquires from the required timetable, information of a required time for the target train corresponding to a departure time difference between the last station departure time of the target train and the next station departure time of the precedent train, and creates a prediction schedule of predicting a station arrival time for the target train to the next station by the use of the acquired information of the required time.

2. The train travel prediction device according to claim 1, wherein the operation prediction unit:

sets a time obtained by adding a station stop time to the predicted station arrival time of the next station as a next station departure time;

creates a prediction schedule of predicting a station arrival time for the target train to a second next station by using information of a train schedule and a departure time difference between a next station departure time of the target train and a second next station departure time of the precedent train at the second next station as a station after the next station; and continues the prediction schedule creating process when there is a stop station of the target train after the second next station.

3. The train travel prediction device according to claim 1, wherein the required time database records a plurality of the required timetables as the required timetable between the stations when different speed limitations are used.

4. The train travel prediction device according to claim 1, wherein the required time database records a plurality of the required timetables as the required timetable between the stations when different travel patterns are used.

5. The train travel prediction device according to claim 1, wherein the required time database records a plurality of the required timetables as the required timetable between the stations in accordance with the type of the train.

6. The train travel prediction device according to claim 1, further comprising:

a required time calculator that calculates the required time of the required timetable.

7. A train travel prediction method of a train travel prediction device including a required time database that records a required timetable created in advance between stations and indicating a relation of a departure time difference between a last station departure time of a target train and a next station departure time of a precedent train with respect to a required time for the target train from a current time to a next station on the assumption that the target train is set as a train subsequent to the precedent train and a stop station subsequent to a last station from which the target train has departed is set as the next station, the train travel prediction method comprising:

acquiring information of a train schedule and a train arrival-departure record including a last station departure time of the target train and a next station departure time of the precedent train;

referring to the required timetable recorded in the required time database on the basis of the train schedule and the train arrival-departure record;

acquiring from the required timetable, information of a required time for the target train corresponding to a departure time difference between the last station departure time of the target train and the next station departure time of the precedent train; and creating a prediction schedule of predicting a station arrival time for the target train to the next station by the use of the acquired information of the required time.

8. The train travel prediction method according to claim 7, wherein in creating the prediction schedule, a time obtained by adding a station stop time to the predicted station arrival time of the next station is set as a next station departure time, a prediction schedule of predicting a station arrival time for the target train to a second next station is created by using information of a train schedule and a departure time difference between a next station departure time of the target train and a second next station departure time of the precedent train at the second next station as a station after the next station, and the prediction schedule creating process is continued when there is a stop station of the target train after the second next station.

* * * * *